US008714945B2

(12) United States Patent
Birchette

(10) Patent No.: US 8,714,945 B2
(45) Date of Patent: May 6, 2014

(54) ULTRA-LOW FRICTION AIR PUMP FOR CREATING OSCILLATORY OR PULSED JETS

(75) Inventor: Terrence S. Birchette, Chandler, AZ (US)

(73) Assignee: The Boeing Company, Chicago, IL (US)

( * ) Notice: Subject to any disclaimer, the term of this patent is extended or adjusted under 35 U.S.C. 154(b) by 52 days.

(21) Appl. No.: 13/178,699

(22) Filed: Jul. 8, 2011

(65) Prior Publication Data

US 2011/0280740 A1 Nov. 17, 2011

Related U.S. Application Data

(62) Division of application No. 11/613,599, filed on Dec. 20, 2006, now Pat. No. 7,980,516.

(51) Int. Cl.

| | |
|---|---|
| ***F04B 53/18*** | (2006.01) |
| ***F04B 9/107*** | (2006.01) |
| ***F04B 39/02*** | (2006.01) |

(52) U.S. Cl.

CPC ..... *F04B 39/0215* (2013.01); *F04B 39/0292* (2013.01); *F04B 9/107* (2013.01)

USPC ..... 417/417; 417/399; 417/415; 244/207; 244/208; 244/209

(58) Field of Classification Search

CPC ... F04B 39/0215; F04B 39/0292; F04B 9/107

USPC ..... 417/399, 404, 415, 402; 244/207–209, 244/200

See application file for complete search history.

(56) References Cited

U.S. PATENT DOCUMENTS

| | | | | |
|---|---|---|---|---|
| 3,146,940 | A * | 9/1964 | McCrory et al. | 417/571 |
| 3,244,357 | A | 4/1966 | Bunker | |
| 4,502,848 | A * | 3/1985 | Robertson et al. | 417/380 |
| 6,056,204 | A | 5/2000 | Glezer et al. | |
| 6,231,027 | B1 | 5/2001 | Baker et al. | |
| 6,471,477 | B2 | 10/2002 | Hassan | |
| 6,528,115 | B1 * | 3/2003 | Hirano et al. | 427/249.1 |

(Continued)

OTHER PUBLICATIONS

"Near-Frictionless Carbon Coating Offer Significant Industrial Benefits", FreedomCAR & Vehicle Technologies Program, Jun. 2004, U.S. Department of Energy, USA.

*Primary Examiner* — Devon Kramer
*Assistant Examiner* — Christopher Bobish
(74) *Attorney, Agent, or Firm* — Ostrager Chong Flaherty & Broitman P.C.

(57) ABSTRACT

An air pump positioned within a hollow space in an aerodynamic structure for controlling the flow over an aerodynamic surface thereof, includes a movable member linearly displaced by a very low friction piston mechanism and a compression chamber open to the exterior of the aerodynamic surface through an orifice. Reciprocal displacement of the very low friction movable member changes the volume of the compression chamber to alternately expel fluid (e.g., air) from and pull fluid into the compression chamber through the orifice. The movable member includes a piston oscillating within a piston housing each having an ultra-low friction coating for improved thermal performance and reduced maintenance. Fluid intake to the compression chamber may be increased through the use of a one-way valve located either in the aerodynamic surface, or in the piston. Multiple flapper valves may surround the orifice in the aerodynamic surface for increased fluid control.

13 Claims, 6 Drawing Sheets

(56) References Cited

U.S. PATENT DOCUMENTS

| | | | | |
|---|---|---|---|---|
| 6,548,173 | B2 | 4/2003 | Erdemir | |
| 6,769,884 | B2 | 8/2004 | Miller | |
| 6,899,302 | B1 | 5/2005 | Hassan et al. | |
| 7,185,431 | B1 * | 3/2007 | Seagar et al. | 29/888.02 |
| 7,527,086 | B2 | 5/2009 | Wang et al. | |

* cited by examiner

ULTRA-LOW FRICTION AIR PUMP FOR CREATING OSCILLATORY OR PULSED JETS

FIELD OF THE INVENTION

This invention relates generally to aerodynamic surfaces and, more particularly, to improved constructions for providing aerodynamic flow control.

BACKGROUND OF THE INVENTION

In general, the aerodynamic efficiency of any lifting surface, regardless of the type of vehicle, is dependent on the lift-to-drag ratio of that surface. Various methods for controlling aerodynamic surfaces on rotor blades, wings, engine inlets, fan blades, and nozzles are known. Movable control surfaces placed on these aerodynamic surfaces have included flaps, slats, spoilers, ailerons, elevators, and rudders. Although these control surfaces can mechanically alter the geometry of the original aerodynamic device, they are limited in their ability to respond quickly and efficiently. Furthermore, such mechanical control surfaces may have a number of disadvantages, including adding complexity to the aerodynamic device, reducing structural integrity, complicating manufacturing, and compromising radar detectability.

Therefore, aerodynamic surfaces such as aircraft wings, helicopter blades or windmill blades are designed to operate efficiently at conditions that maximize lift and minimize the attendant drag penalty. Under certain operating conditions, for example at high angles of attack, boundary layer separation occurs resulting in a loss of lift and a simultaneous increase in drag, thereby compromising the aerodynamic efficiency of the surface. In recent years the use of active flow control as a means to improve aerodynamic efficiency of a surface over a wide range of operating conditions (e.g., varying Mach numbers and Reynolds numbers) has met great success. Numerous wind tunnel investigations have shown that significant aerodynamic benefits are achievable through the use of low momentum oscillatory or pulsed jets. These benefits include improved stall and post-stall lift characteristics which offer simultaneous reductions in drag. For a typical rotor blade or wing, these benefits translate into an increase in useful payload, reductions in power requirements resulting in fuel savings, or an increase in aircraft range for the same power.

Prior successful attempts to achieve some of these advantages have incorporated devices known as synthetic jet actuators into various aerodynamic surfaces, for example, helicopter blades. A synthetic jet includes a movable diaphragm or piston positioned within a pump chamber. Movement of the diaphragm or piston pulses air in and out of the chamber through an orifice. In the context of a wing or blade, the moving member is positioned within a hollow portion of the air pump actuator structure and pulses air in and out of one or more orifices in the outer aerodynamic skin. The outer skin thus may be made relatively porous and the wing or blade may have a plurality of such synthetic jets incorporated therein for active flow control. See, for example, U.S. Pat. Nos. 5,813,625; 5,938,404 and 6,471,477 each of which are incorporated herein by reference.

The prior art has also utilized electromagnetically-driven air pumps to generate oscillatory or pulsed jets but these have demonstrated limited reliability due to thermal limitations and shortened life cycles. These devices overheat due to the electrical energy needed for cyclic operation of electromagnetically-driven prior art air pumps.

A further limitation of such devices involves the displacement and frequency requirements for delivering pulsed blowing or suction configurations and is also limited by weight penalties and speed constraints. A typical electromagnet pulsed jet cannot deliver adequate flow at a high frequency on the order of 300 Hz. These prior devices generate and convey local heat energy to the surface port but the thermal energy cannot be dissipated quickly enough for satisfactory performance.

The subject ultra-low friction air pump design improves upon these prior designs and can convey thermal energy away from the surface in a more efficient manner, particularly when used in conjunction with pneumatic or hydraulic systems instead of the aforementioned electromechanical systems. Excess heat energy can be removed by conventional means such as by a heat exchanger or by conduction through supply lines, but in general, the frictional heat generated from the subject ultra-low friction air pump is minimal due to the improved frictional properties of the oscillating components.

Additionally, the ultra-low friction air pump also provides improvements in useful life cycle operations for such devices.

Thus, a primary objective of this invention is to present a ultra-low friction design for an air pump device for generating oscillatory or pulsed blowing or suction jets.

SUMMARY OF THE INVENTION

The general features of the present air pump include a compression housing assembly incorporated into an aerodynamic surface. The air pump is spaced from the aerodynamic surface by a circular or rectangular tubular structure which defines a cavity. This cavity is in communication with the surrounding ambient air through an orifice formed in the aerodynamic surface.

Oscillatory motion of a piston within the actuator pump causes air to pulse in and out of the orifice. Outward pulsing of air through the orifice creates a synthetic jet. Control of the frequency and magnitude of the piston oscillation based upon free stream conditions can improve the performance of the aerodynamic surface. The shape of the orifice may be varied or directed so as to produce a desired fluid flow pattern into the surrounding free stream air flow. For example the orifice may be nozzle shaped.

The present design provides an ultra-low friction lightweight air pump which can be readily scaled in size to accommodate a wide range of mass flow rates and requirements. The pump consists of a housing assembly, piston assembly, shaft assembly, seals and bushings. The housing is typically cylindrical but may vary to conform with installation requirements. The piston offers a flat surface which can consist of any planar shape, e.g., circular, oval, square, or rectangular.

The ultra-low friction air pump assembly benefits from the use of lightweight advanced materials as well as its novel design. The housing can be made of plastic, aluminum, titanium or a carbon-fiber composite depending on its intended application specifications. Typically, the key application specifications are size constraints, operational performance of the pumping action, and durability under expected operating conditions. The piston may be a disk made from a light weight honeycomb-shaped core that is sandwiched by carbon-epoxy composite plies. The piston seal is preferably an aluminum ring which may be coated with an ultra-low friction material and bonded to the piston perimeter, forming the piston assembly.

One embodiment consists of a light weight air pump that makes use of an ultra-low friction amorphous carbon film coating on the frictional sealing surfaces. The principal frictional sealing surfaces include the inner surface of the piston housing, the inner surface of one or more shaft bushings and optionally as mentioned above, the outer edge of the piston seal. The ultra-low friction coating was developed by Argonne National Laboratory in accordance with the method described in U.S. Pat. No. 6,548,173 which is incorporated herein by reference. The low friction amorphous carbon coating is applied to the inner surface of the housing against which the piston will oscillate, as well as the inner surface of the bushings in either pump cover through which the shaft assembly will oscillate.

Thus, the piston bore and the inner bores of the shaft bushings are coated with a thin film approximately 3 microns thick which provides a low coefficient of friction, approximately 0.02 to 0.07, while also providing good wear resistance. The disclosed air pump design allows for efficient energy consumption to generate oscillatory or pulsed jets over extended periods of operation due to the ultra-low friction coating and high thermally conductive housing. Further, the disclosed pump produces less heat during operation which will extend the life of the pump.

One embodiment provides an air pump for control of pulsed airflow including a hollow space adjacent an aerodynamic surface and an orifice opening through the aerodynamic surface adjacent to the hollow space. A substantially rigid movable member fits within the hollow space and includes a piston connected by a shaft element defining an axis. The piston assembly is a movable member and is substantially symmetric in terms of its mass about a plane extending perpendicularly through the mid-point of the structure. The piston assembly axis extends in a direction that intersects the aerodynamic surface substantially normally so that the piston may actively influence the aerodynamic flow. The piston is coupled to and driven by pneumatic or hydraulic means to power the air pump in a controlled fashion.

In a preferred embodiment, the piston is flat and thin relative to the axis. The piston may be circular or another non-circular shape. The movable member is desirably made substantially of composite materials such as carbon-fiber reinforced thermosetting or thermoplastic resins suitable for fabricating structural components. These structural components can be honeycomb laminates, pre-preg layups and like structural members.

If desired, one or more one-way valve openings to the compression chamber may be utilized. In a first configuration, the one-way valve permits fluid to be pulled therethrough into the chamber upon expansion of the chamber, but prevents fluid from being expelled therethrough from the chamber upon compression of the chamber. In another configuration the opposite effect may be achieved. In addition, active control valves may be selected in place of passive controls. Selection of either type one-way valve or a combination of valves will enable the subject air pump actuator to operate in a blowing mode, suction mode or combination of both.

In another embodiment, the one-way valve is located in the aerodynamic surface, and preferably a plurality of such valves surround the orifice. Alternatively, the one-way valve is located in the piston. The one-way valve may comprise a flapper valve, such as a plate-like structure anchored along one edge and cantilevered over an opening to the compression chamber. In another embodiment, the plate-like structure is made of a composite material, while in another embodiment the material is stainless-steel. Desirably, a plurality of plate-like valve structures can be utilized. These may preferably be anchored within a recess formed in an inner face of the aerodynamic surface.

Other objects, features and advantages of the present invention will be apparent when the detailed descriptions of the preferred embodiments of the invention are considered with reference to the accompanying drawings, which should be construed in an illustrative and not limiting sense as follows:

DESCRIPTION OF THE PREFERRED EMBODIMENTS

Figure 1:
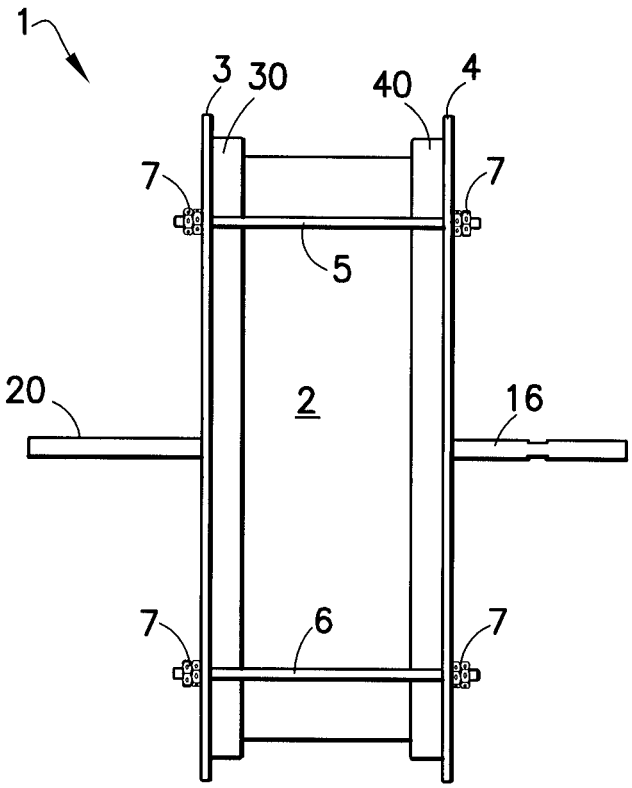
FIG. 1 is an elevation view of the air pump assembly.

FIG. 1 depicts airfoil air pump assembly 1. The air pump assembly utilizes air pump housing 2 which has, respectively, rear housing cover 40 and front housing cover 30. The housing covers are held in place with rear cover ring 4 and front cover ring 3, the covers and cover rings are held securely in place on housing 2 with studs 5 and 6 which are fastened with jam nuts 7. Typically, four such studs will be sufficient. In this view, air pump shafts 16 and 20 are seen protruding from housing 2.

The air pump shown in FIG. 1 may be installed in proximity to and in communication with an aerodynamic surface. In one configuration, the air pump operates during travel by injecting a pulsed air flow into the air stream moving over the aerodynamic surface. The air pump operates at frequencies up to 300 hertz in a cyclic manner with reduced required energy input as a result of the use of an ultra-low friction amorphous carbon coating on frictional surfaces of key low inertia movable components. The key surfaces are the outer perimeter of the piston assembly and inner bores of the piston housing and shaft bushings. Energy input is preferably supplied from conventional sources to operate the air pump. It is preferred that hydraulic or pneumatic energy inputs be utilized to power the air pump assembly, however, those skilled in the art will be able to configure the device to utilize any available power source including electrical and mechanical inputs. The power input is combined with a conventional servo-valve or proportioning valve for command and control of the air pump speed and piston displacement. Because the frictional losses from the air pump are low, the primary forces to overcome are due to the inertia of the piston and the compression of air ahead of the piston. The ultra-low friction coating also provides reduced wear and maintenance and causes the air pump to operate at a lower temperature due to the reduced friction.

Figure 2:
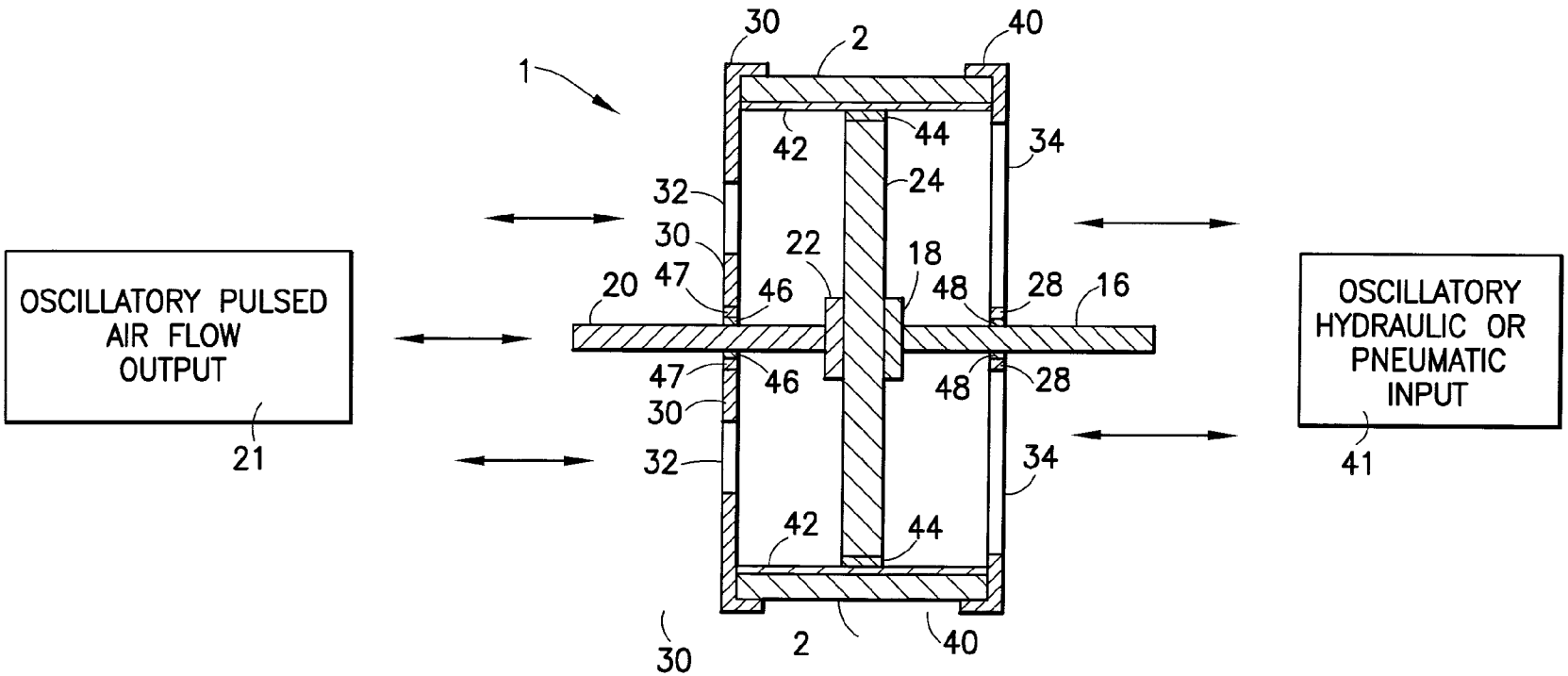
FIG. 2 is a cross-section of the air pump assembly.

FIG. 2 is a schematic diagram depicting the operation of the airfoil air pump assembly shown in cross-section. The air pump assembly 1 is powered in an aircraft or other configuration by a conventional oscillatory hydraulic or pneumatic input 41. Logic control for such an apparatus is also conventional. The air pump assembly acts on an airfoil with an oscillatory or pulsed airflow output 21. In FIG. 2, the rear air pump shaft 16 is connected via flange 18 to piston assembly 24. Front shaft 20 is similarly attached via flange 22 to piston assembly 24. The flanges may be screwed together. Alternatively, the flanges may be spacers and the shaft rods may be threaded together. In FIG. 2, upper and lower cross-sections of housing 2 are coated with ultra-low friction amorphous carbon coating 42. The upper and lower cross-section edges of piston assembly 24 are also seen in this view coated with ultra-low friction amorphous carbon coating 44. Front shaft 20 runs through bushing 47 and front cover 30. The inner surface of bushing 47 has also been coated with ultra-low friction amorphous carbon coating 46. Rear shaft 16 runs through rear cover 40 and bushing 28. Bushing 28 has also been coated with ultra-low friction amorphous carbon coating 48. Optional active or passive air flow control mechanisms 32 and 34 are depicted in the front and rear covers 30 and 40. These air flow control means may be the one-way flapper valves described above.

FIG. 2 depicts the air pump in blowing-suction configuration providing oscillatory or pulsed airflow output.

Figure 3:
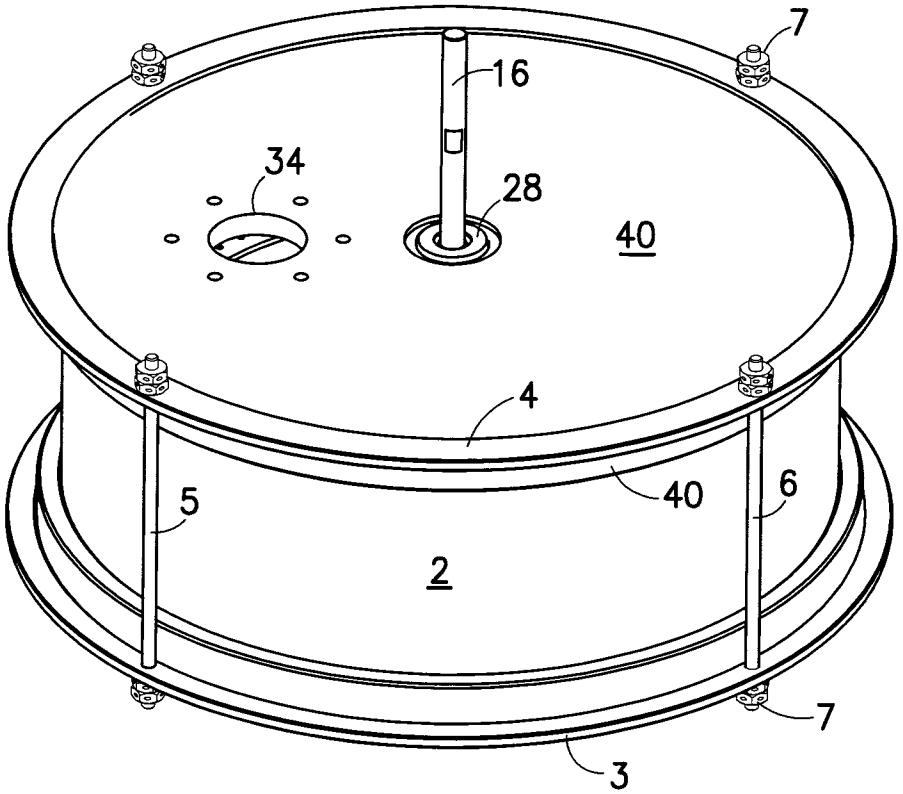
FIG. 3 is a perspective view of the air pump assembly.

FIG. 3 is a perspective view of the airfoil air pump assembly having housing 2 and rear cover 40. Front and rear covers 30 and 40 are secured with front and rear cover rings 3 and 4 which are made secure via studs 5 and 6 and jam nuts 7. In this view, shaft 16 is seen passing through bushing 28 which has been coated with the ultra-low friction amorphous carbon coating described earlier. Also in this view, a one-way valve is deployed inside cover 40 as seen through air flow port 34.

Figure 4A:
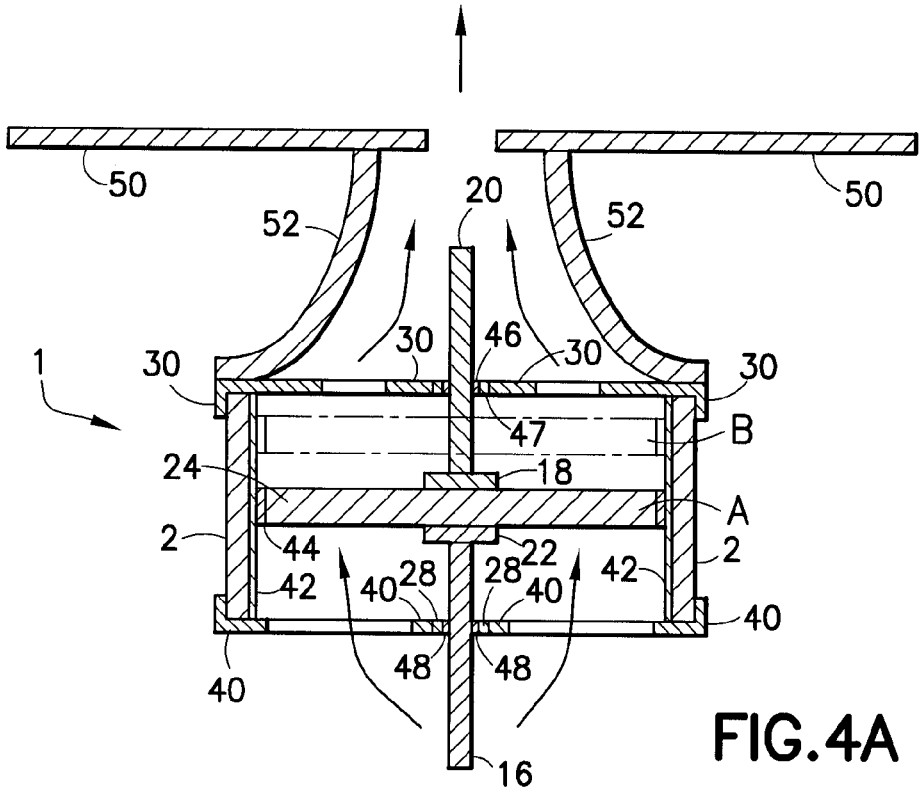
FIGS. 4A to 4D are cross-sectional views of the air pump assembly showing operational details.

FIGS. 4A through 4D depict in cross-sectional format the operation of the airfoil air pump assembly 1 of the invention. In these views, airfoil 50 is seen in cross-section as is airframe 52 which is connected both to the airfoil 50 and the air pump assembly 1 by conventional fasteners such as screws or brackets. FIG. 4A depicts a range of piston motion from neutral position A to second position B, wherein the airflow is depicted by directional arrows from the pump through the airfoil to the outside. In FIG. 4A, piston assembly 24 operates in a very low friction matter due to respective ultra-low friction amorphous carbon coatings the coatings 42, 44, 46 and 48.

Figure 4B:
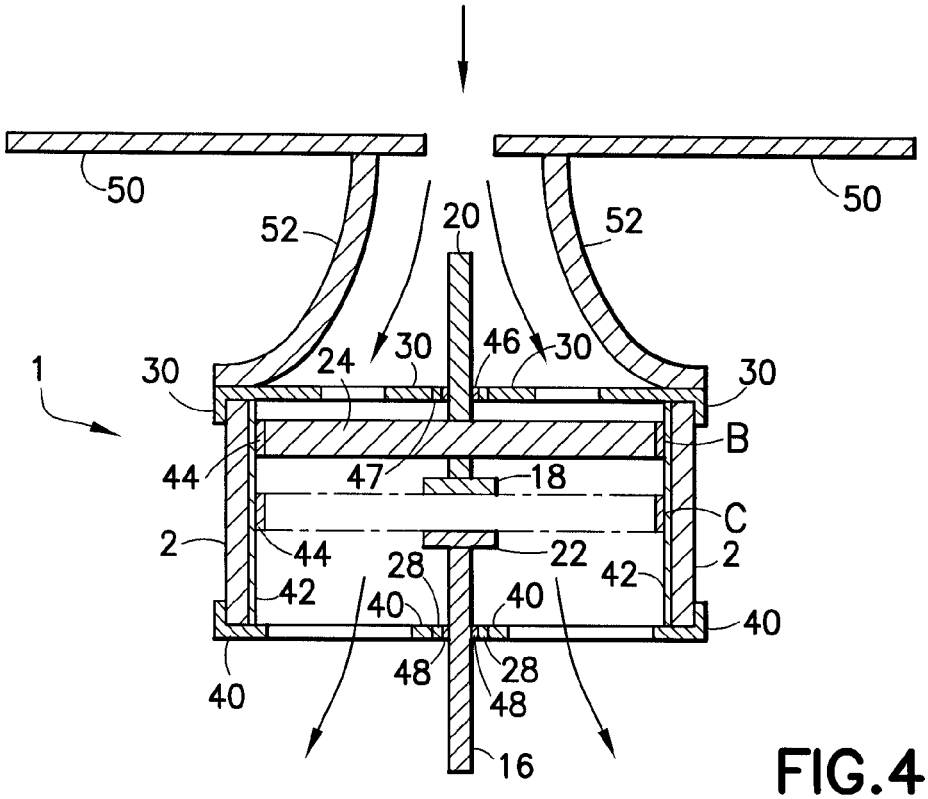

FIG. 4B depicts a range of motion from position B to position C for piston assembly 24. The airflow indicators depict air being drawn through airfoil 50 from the outside and into pump assembly 1.

Figure 4C:
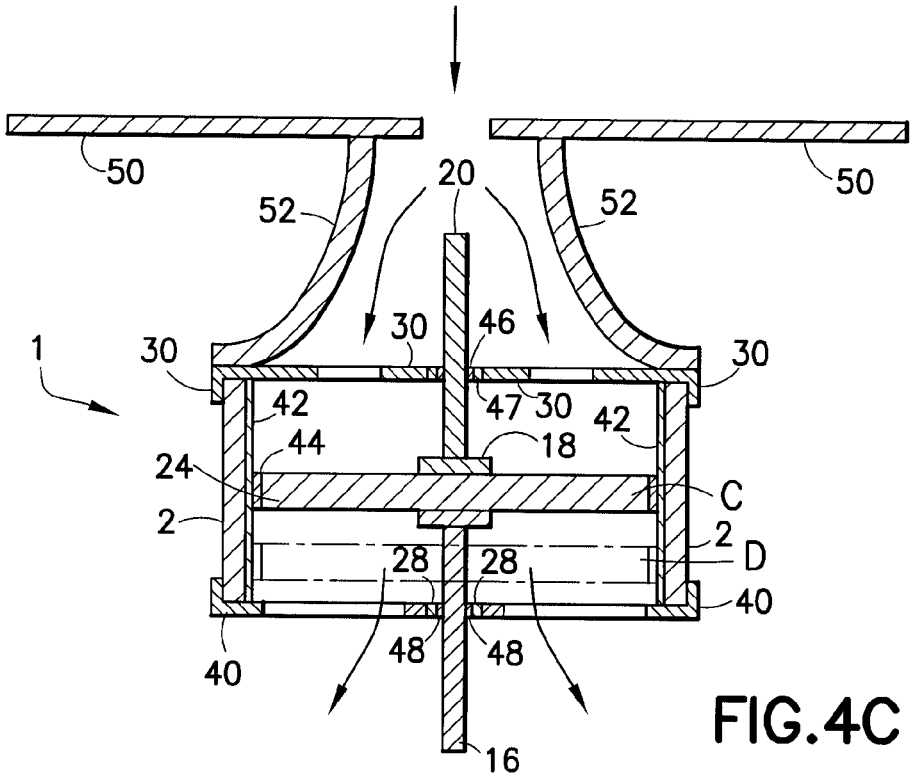

FIG. 4C depicts a range of motion for piston assembly 24 from position C to position D which continues to facilitate airflow through airfoil 50 from the outside and into the air pump housing assembly (2).

Figure 4D:
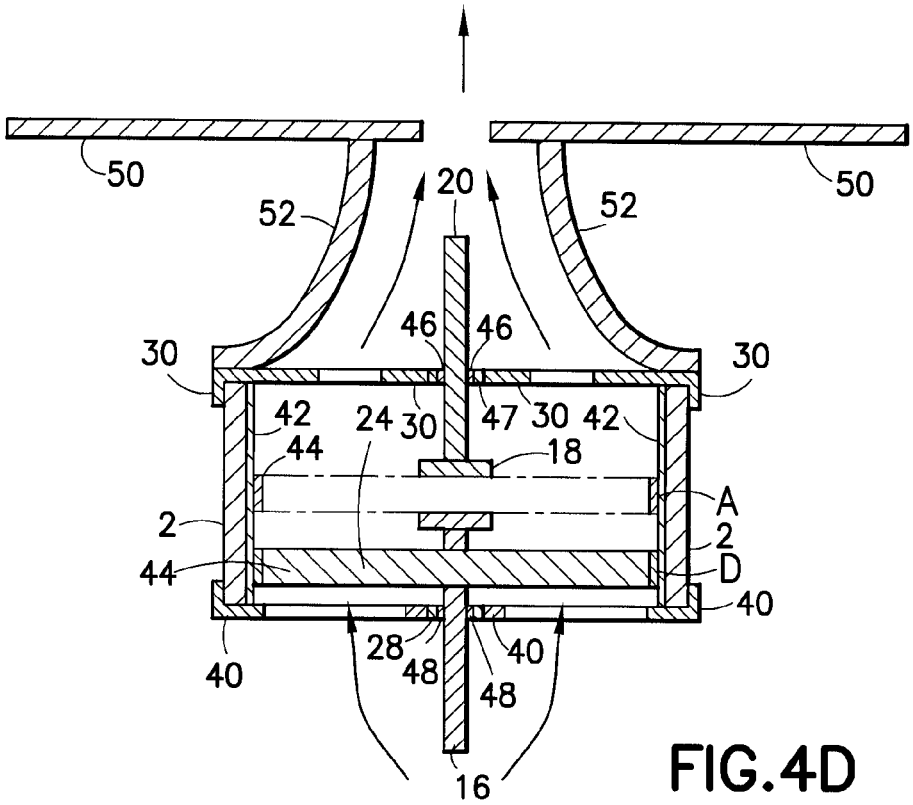

Finally, in FIG. 4D, piston assembly 24 returns to its original neutral position by traveling from position D to position A which begins to reverse airflow from the pump assembly through airfoil 50 to outside the aircraft.

Figure 5:
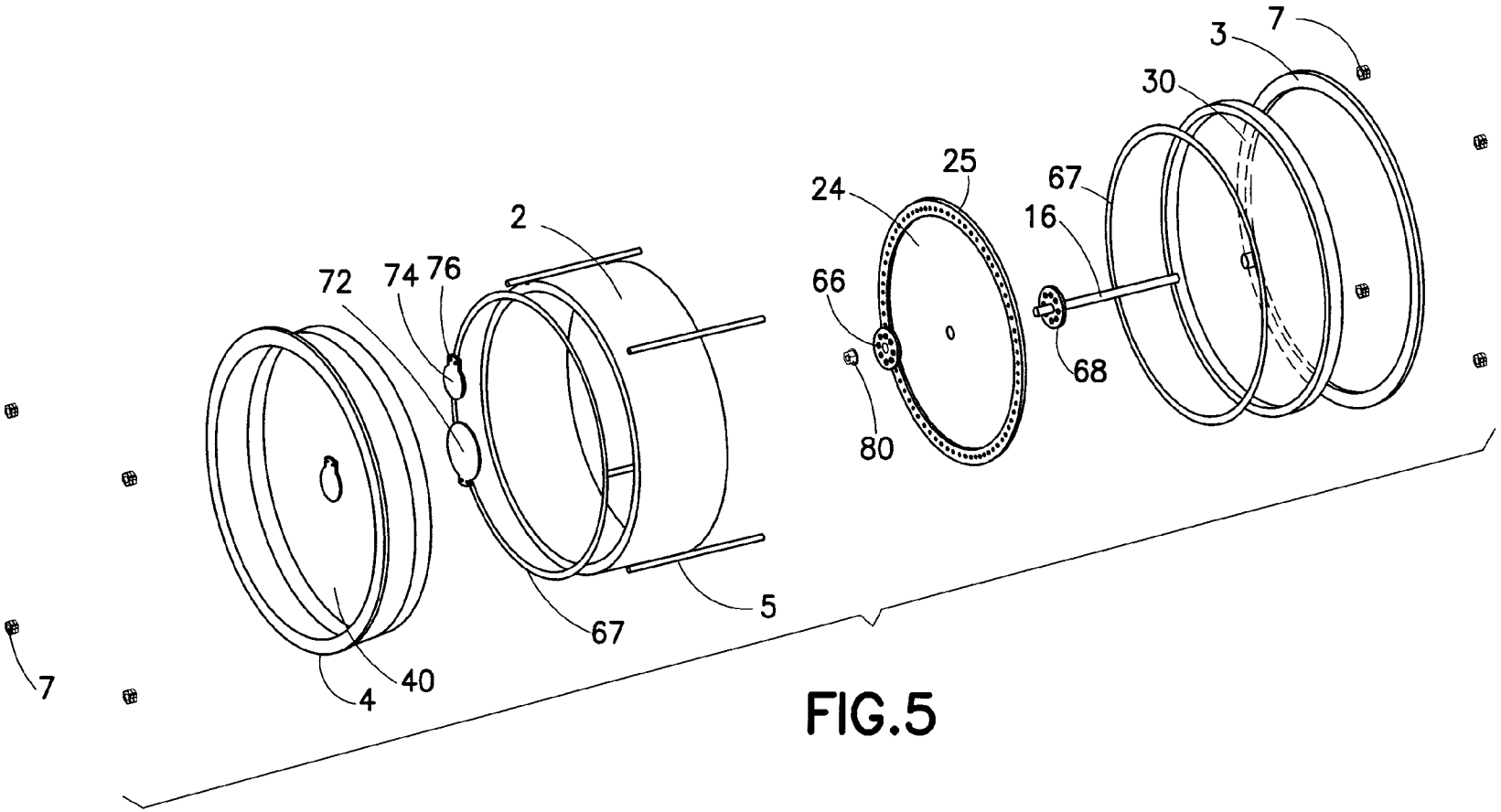
FIG. 5 is an exploded perspective view of the air pump assembly.

FIG. 5 depicts an embodiment of the airfoil air pump assembly in exploded detail. Flanges 66 and 68, on either side of piston assembly 24, secure the shafts such as shaft 16 shown here. Piston assembly 24 includes a central hole for the shaft to pass through. Piston assembly 24 also includes seal ring 25 which in this embodiment is an aluminum ring bonded to the circumferential edge of the piston disk. The piston seal is preferably an aluminum ring, and more preferably a two-piece aluminum ring, which is bonded to the perimeter of the piston disk forming the piston assembly. In this embodiment, threaded shaft 16 is secured to the flanges with nut 80. The circumferential sealing edge 25 of piston assembly 24 may optionally be coated with the ultra-low friction amorphous carbon coating described below. It is preferred, however, that the ultra-low friction coating be utilized on the inner cylindrical surfaces of housing 2 and the respective shaft bushings 28 and 47 shown in FIG. 2. The front and rear covers are secured respectively with rubber O-rings 67 to seal the covers to the housing. In this embodiment, these covers and O-rings are secured with front and rear cover rings 3 and 4.

Also in FIG. 5, optional flapper valves 72 and 74 are secured to cover 40 by socket head screws 76. These cantilevered flapper valves facilitate and direct airflow to or from the assembly, and may be of the passive or active type. Such valves are selected to perform in a blowing or suction configuration or a combination of both configurations, in accordance with a selected airfoil actuator configuration.

One or more one-way valves are desirably evenly distributed about the central orifice of the pump assembly. Each one-way valve comprises a generally rectangular plate fastened at one end into recessed grooves located in the aerodynamic surface. A pair of outwardly directed notches defines a bending access that separates the plate into an anchored portion and a cantilevered portion. It will be appreciated that fluid flow created within the chamber bends the cantilevered portion of each one-way valve thus selectively permitting fluid intake or outflow through respective orifices. Such structures are generally termed flapper valves. Various other valves or air intakes can be used in place of the disclosed one-way valves to increase the fluid intake available for the system.

The plates of the one-way valves may be made of a variety of materials calibrated to the number and the size required. For example the plates may be fabricated out of 0.005 inch thick stainless steel or from 0.003 inch thick light-weight graphite laminate material.

There are three basic configurations for this design of air pump. The first is for oscillatory blowing and suction using a blowing-suction configuration (BSC), the second is for pulsed blowing using a blowing configuration (BC) and the third is for pulsed suction using a suction configuration (SC).

The air pump in blowing-suction configuration is depicted in FIGS. 4A-4D. The piston displacement and inlet and exit air flow profiles are also shown in these figures which have a typical sinusoidal piston travel for one cycle. In this embodiment, the pump operates as the piston rod is moved from its neutral position to top dead center (TDC), then to bottom dead center (BDC) and back to neutral at a frequency up to 300 Hertz and with a displacement in the range of ±0.06" to ±0.13". The rear of the assembly, away from the aerodynamic surface, is open to the surrounding environment. This is accomplished by a means of relatively large ports in the rear cover. The rear cover also contains a bushing having an inner bore coated with the ultra-low friction coating. The front cover contains air flow exit ports smaller in diameter than the piston bore diameter, thus emitting a high speed, high pressure flow upon exit. The exiting air flows from the motion of the piston moving towards TDC and pushing the air within the housing through the forward cover exit ports. The same exit ports are also used as inlet ports for the piston's motion towards BDC where the air in the surrounding environment is sucked into the housing bore, thereby causing a negative pressure inside the cylinder. The front cover also contains a bushing with its inner bore coated with the ultra-low friction coating. The shaft assembly is comprised of two shafts fastened together to provide structural stability for the piston assembly. The shaft assembly also acts as a guide for the piston motion and to maintain a centered alignment within the housing.

The piston assembly and shaft assembly are free to move in translation as well as rotation. Rotational motion will be about the centerline of the shaft assembly's longitudinal axis. The cyclic motion of the piston assembly produces a displacement waveform that results in a similar waveform of air flow entering and exiting the front cover ports. The piston assembly's cyclic displacement can produce an infinite number of cyclic waveform shapes and an infinite number of periods depending on the shaft assembly's velocity.

In the blowing configuration the rear cover has the same configuration as the blowing-suction configuration. The front cover contains air flow exit ports smaller in diameter than the piston bore diameter and thus results in a higher static pressure upon exit. The exiting air flow travel is from the motion of the piston moving to TDC and pushing the air within the housing through the forward cover exit ports. The front cover contains a passive or active reed valve, such as a flapper, which mechanically bends and opens the exit ports for the exiting flow (i.e. blowing). Upon the return travel to BDC of the piston, the flow is blocked from the exit ports. A second reed valve, located on the front cover, allows the external surrounding air to enter the housing thus relieving the negative pressure during the piston's return displacement. A solenoid, hydraulic or pneumatic valve or electro-hydraulic servo-valve may be also used in place of a passive reed valve.

The relief in pressure reduces the force acting on the piston. The front cover also contains a bushing with its inner bore coated with the ultra-low friction coating. The shaft assembly and piston assembly are similar to the BSC. The shaft assembly also acts as a guide for the piston motion and to maintain a centered alignment within the housing.

For the suction configuration, the rear cover is again in the same configuration as with the blowing-suction configuration. The front cover contains air flow inlet ports smaller in diameter than the piston bore diameter and therefore results in lower air pressure upon inlet. The inlet air flow travel is formed from the motion of the piston moving rearward and sucking the air into the housing through the forward cover inlet ports. The front cover contains passive or active reed valves which mechanically bend and open the inlet ports for vacuum (i.e. suction). Upon the forward travel of the piston the flow is blocked from the inlet ports. A second set of reed valves are located on the front cover and allow the housing air to exit thus relieving the positive pressure (i.e. compression) during the piston's forward displacement. A solenoid, hydraulic or pneumatic valve may be used in place of the passive reed valves. The relief reduces the compressive force acting on the piston. The front cover also contains a bushing with its inner bore coated with the ultra-low friction coating.

The power required to displace the air pump piston at a specified velocity is primarily due to three factors which are a function of inertia, frictional forces and fluid compressibility. The inertial forces vary with the weight of the hydraulic or pneumatic actuator shaft, the coupling between the actuator shaft and air pump piston shaft, the air pump piston shaft, and the air pump piston assembly. The frictional forces vary with the motion of the hydraulic or pneumatic actuator shaft in contact with the seals, the air pump piston shaft in contact with ultra-low friction bushings, and ultra-low friction seal of the air pump piston in contact with the air pump inner housing wall. The compressibility forces vary with the selected hydraulic actuator fluid, the pneumatic actuator fluid, i.e., air, and the volume of air contained within the air pump.

Preferably, the ultra-low friction carbon film is manufactured from $CH_4$ and $H_2$ which are chemically vapor deposited onto respective component work pieces by varying the percentage ratio of carbon and hydrogen gases during the vapor deposition process. A typical percentage range for $CH_4$ and $H_2$ gases are 25 to 100% for $CH_4$ and 0-75% for $H_2$. The air pump component work pieces are first cleaned and then affixed to a non-movable support structure. The work piece to be treated is affixed in such manner as to minimize distortion which may occur when the piece is heated to the vapor deposition temperature. Typically, the components will be heated under vacuum in a chamber to approximately 200° C., with the temperature varying with the specified material. The temperature may also be adjusted for the specific amount and condition of chemical vapor deposition of the ultra-low friction amorphous carbon film to be applied. Chemical vapor deposition in this manner provides approximately 3 micron film thickness to the selected component surfaces, while baking at approximately 200° C. Film thickness may be varied from about 0.5 micron to about 10 microns, or more, in accordance with selected performance criteria for the individual parts, as well as the intended life- or duty-cycles of a specified apparatus. The treated component work pieces are then cooled to ambient temperature.

If desired, the work pieces to be coated with the ultra-low friction film may be first pretreated with $SiH_4$, with or without oxidation, to form an intervening bonding layer of silicon or $SiO_2$.

The prototype test article had an 8" diameter piston. In operation the sinusoidal commanded voltage with displacement feedback is set at ±0.125" and a frequency of 300 Hz.

The rigid piston assembly is desirably constructed of a suitably stiff composite material, for example a matrix and a filler, having alternating solid and honeycomb laminates. One particular preferred matrix material is NOMEX substrate discussed below. If desired, the piston structure can be further stiffened through the use of graphite skins that have either a woven or unidirectional fiber orientation.

In a preferred embodiment, at least two layers of unidirectional graphite skins are applied to a substrate of honeycombed NOMEX, the graphite skins being oriented along different axes. The resulting composite construction is extremely stiff while also being lightweight. The increased stiffness of the piston minimizes elastic deflections and greatly improves air pump performance at higher operating frequencies.

Typical assembly of the air pump begins with mounting the piston assembly to the shaft with a spacer and nut. The piston assembly with shaft, spacer and nut is inserted into the housing. The piston is preferably a carbon fiber and honeycomb composite sandwich structure where the honeycomb composite has either a paper or NOMEX substrate. NOMEX is a flame retardant meta-aramid which may be saturated with resin such as phenolic resin. The fabrication of the composite sandwich is completed by application of a carbon fiber fabric plies impregnated with curable resin, preferably curable epoxy resin. The carbon fiber fabric is applied to both sides of the honeycomb with film adhesive facing and is cured under vacuum to provide the piston assembly. The matrix material can be commercially available carbon fiber cloth of uni-directional, plain weave or any available harness pattern. The cloth would be either pre-impregnated with a reactive epoxy resin system or a dry fiber cloth where the curable resin would be added into the cloth just prior to fabrication. Processing temperatures of the fabrication cure system are typically 250° F. to 350° F.

The housing, housing rings, front and rear covers, spacers, shafts, flapper valves and bushings can be made of any combination of conventional materials of suitable strength such as plastic, aluminum, titanium, metal-matrix composites or carbon fiber composites. The inner cylindrical surface of the pump housing is coated with the ultra-low friction amorphous carbon film material. The studs may be any metallic material or combination of metal and carbon fiber composite. Fasteners are typically metallic nuts which may be threaded onto the shafts or studs as required.

The front and rear covers are sealed with O-rings and placed on the ends of the housing. When a double ended piston shaft configuration is used, the front cover will have a bushing, pressed and centered in place. This bushing will have a coating of the ultra-low friction carbon film on its inner cylindrical surface. The cover may also have one or more flapper valves mounted using screws or the like. The valves are selected to conform to a blowing or suction or combination configuration. The rear cover contains a pressed and centered bushing which is coated with the ultra-low friction material on its inner cylindrical surface. Housing rings are placed on the outboard ends of the covers to secure the covers to the housing.

A rear shaft operates in cooperation with the oscillatory pneumatic or hydraulic power input. The optional front shaft may also be utilized to interact with the airflow control over an airfoil. These shafts are generally metal rods but composite materials may be utilized as well.

The invention now being fully described, it will be apparent to one of ordinary skill in the art that many changes and modifications can be made thereto without departing from the spirit or scope of the invention as set forth herein.

The invention claimed is:

1. A method for controlling air flow over an aerodynamic surface of an airfoil comprising the step of oscillating or pulsing an air jet through an orifice opening in the aerodynamic surface of the airfoil with a controllable, ultra-low friction air pump positioned adjacent to the orifice opening, the air pump having:

an air pump housing including a hollow space with an interior surface coated with a film of ultra-low friction amorphous carbon having a thickness of approximately 0.5 to 10 microns;

a substantially rigid and flat movable piston made substantially of composite materials and positioned within the air pump housing to be slidable against the interior surface, the piston being substantially symmetric in terms of its mass about a plane extending perpendicularly through a mid-point of the air pump housing;

the piston connected to a first shaft element defining an axis of travel and traveling within at least one bushing coated with the ultra-low friction film of amorphous carbon, the piston being thin relative to the axis of travel and the air pump housing, the axis of travel extending in a direction that intersects the aerodynamic surface of the airfoil substantially normally so that the piston oscillates through a neutral centered position along the axis of travel, and the combination of the piston and the first shaft element within the hollow space defining a compression chamber open to an exterior of the aerodynamic surface of the airfoil effective for aerodynamic flow control, whereby the piston, shaft and housing effectively cooperate in operation of the air pump in an ultra-low friction manner of aerodynamic flow control.

2. The method of claim 1 wherein the air pump is operated in a blowing configuration.

3. The method of claim 1 wherein the air pump is operated in a suction configuration.

4. The method of claim 1 wherein the air pump is operated in a combined blowing-suction configuration.

5. The method of claim 1, further comprising the step of:

pretreating the piston with a bonding layer of silicon or $SiO_2$ before coating the piston with the ultra-low friction amorphous carbon film.

6. The method of claim 1, further comprising the steps of:

connecting the piston to a second shaft element positioned opposite the first shaft element on the axis of travel, the second shaft element positioned to travel within a second bushing; and coating the second bushing with the ultra-low friction film of amorphous carbon on its inner cylindrical surface.

7. The method of claim 1, further comprising the step of oscillating or pulsing the piston to pull fluid into the compression chamber through the orifice opening of the aerodynamic surface of the airfoil.

8. The method of claim 1, wherein the piston is oscillated or pulsed with a hydraulic control means or a pneumatic control means.

9. A method for controlling air flow over an aerodynamic surface of an airfoil comprising the steps of:

providing an orifice opening in the aerodynamic surface of the airfoil;

positioning a housing of an air pump adjacent to the orifice opening, the housing having a hollow interior space with an interior surface;

coating the interior surface of the housing with a film of ultra-low friction amorphous carbon having a thickness of approximately 0.5 to 10 microns;

providing a substantially rigid and flat piston made substantially of composite materials within the housing such that the piston is slidable against the interior surface, the piston being substantially symmetric in terms of its mass about a plane extending perpendicularly through a mid-point of the housing;

connecting the piston to a first shaft element positioned to travel within at least one bushing in, and defining an axis of travel within, the housing, the piston being thin relative to the axis of travel, the axis of travel extending in a direction that intersects the aerodynamic surface of the airfoil substantially normally so that the piston oscillates through a neutral centered position along the axis of travel, the combination of the piston and the first shaft element within the hollow space defining a compression chamber open to an exterior of the aerodynamic surface effective for aerodynamic flow control;

coating the at least one bushing with the ultra-low friction film of amorphous carbon, such that the piston, the first shaft element and the housing effectively cooperate in operation of the air pump in an ultra-low friction manner of aerodynamic flow control; and oscillating or pulsing the piston to expel an air jet through the orifice opening of the aerodynamic surface of the airfoil.

10. The method of claim 9, further comprising the step of:

pretreating the piston with a bonding layer of silicon or $SiO_2$ before coating the piston with the ultra-low friction amorphous carbon film.

11. The method of claim 9, further comprising the steps of:

connecting the piston to a second shaft element positioned opposite the first shaft element on the axis of travel, the second shaft element positioned to travel within a second bushing; and coating the second bushing with the ultra-low friction film of amorphous carbon on its inner cylindrical surface.

12. The method of claim 9, further comprising oscillating or pulsing the piston to pull fluid into the compression chamber through the orifice opening of the aerodynamic surface of the airfoil.

13. The method of claim 1, wherein the piston is oscillated or pulsed with a hydraulic control means or a pneumatic control means.

* * * * *